United States Patent [19]

Purdon

[11] 4,046,152

[45] Sept. 6, 1977

[54] CIGAR-CIGARETTE PERFORATING DEVICES

[76] Inventor: Jac Eduard Purdon, 16934 Village Lane, Grosse Pointe, Mich. 48230

[21] Appl. No.: 722,782

[22] Filed: Sept. 13, 1976

[51] Int. Cl.[2] ..... A24F 13/00

[52] U.S. Cl. ..... 131/170 R; 131/253

[58] Field of Search ..... 128/259, 253, 188, 233, 128/190, 170

[56] References Cited

U.S. PATENT DOCUMENTS

| | | | |
|---|---|---|---|
| 174,488 | 3/1876 | Conkey | 131/254 |
| 814,937 | 3/1906 | Bussey et al. | 131/254 |
| 3,405,718 | 10/1968 | Grassi | 131/253 X |

*Primary Examiner*—Stephen C. Pellegrino

[57] ABSTRACT

A device no larger in circumference than a silver dollar, and no thicker than three-tenths of an inch (when designed for perforating a normally dimensioned cigarette), having a hole in its center used to receive the item to be perforated.

2 Claims, 4 Drawing Figures

Figure 1
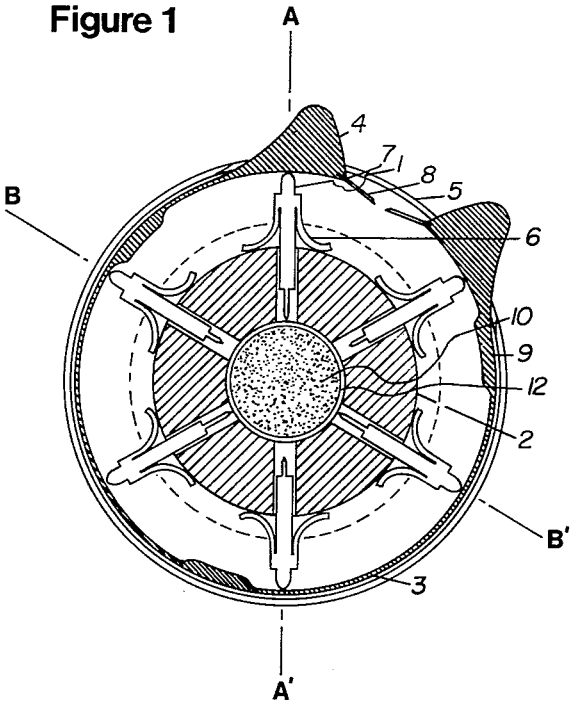
Figure 2
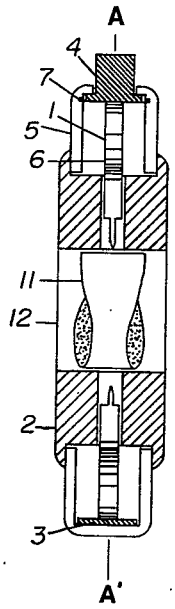
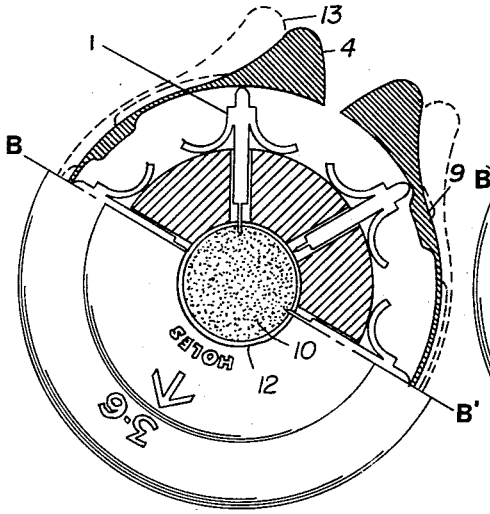
Figure 3
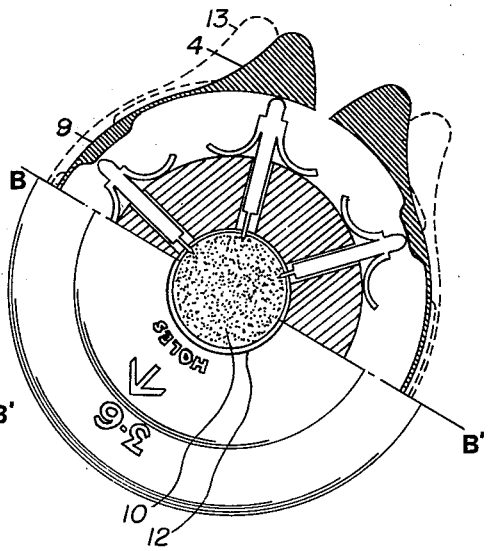
Figure 4

CIGAR-CIGARETTE PERFORATING DEVICES

BRIEF SUMMARY OF THE INVENTION

This invention relates to improvements in smoking accessories and, more particularly, to a device used for perforating the paper wrapping of a cigarette to form a ring of air holes therein and around said wrapper.

This invention will produce a circumferential array of evenly spaced holes around the barrel of a cigarette. The user shall be able to select the number of holes to be made in the cigarette by a simple adjustment of the device's parts.

It has become common practice to ventilate smoking items for the purposes of air cooling and chemical reduction. This invention will assist in these processes by its characteristics of small size, easy operation, accuracy and selectivity of number of holes to be perforated.

This invention embodies certain design principals, and combinations of working parts that allow its construction and manufacture to be of molded plastic.

These and other aspects of the invention will become apparent from the following description of the accompanying drawing in which:

FIG. 1 is a cross section of the device looking down the barrel of the inserted cigarette;

FIG. 2 is a cross section of the device looking at the side of the inserted cigarette.

FIG. 3 is a cross section 1 with the perforating elements activated for minimal hole formation; and FIG. 4 is a cross section 1 with the perforating elements activated for maximum hole formation.

Both FIGS. 3 and 4 display half of the device's exterior casing.

DETAILED DESCRIPTION

In FIG. 1, a cross section of the device looking down the barrel of an inserted cigarette 10 and FIG. 2, a cross section of the device looking at the barrel side of an inserted cigarette 11, there is shown the perforating elements 1 at rest in the perforating element's guide spool 2 with centered cigarette receiving hole 12. The perforating elements are held in position from the tops by a circumferential band 3, having a finger-pinch protrusion 4, at each end. The circumferential band 3 is held in place by its inherent spring tension and the device's exterior casing 5. The perforating elements 1 are held radially outward against the circumferential band 3 by a tension mechanism.

In this drawing, two spring arms are formed as part of each perforating element. Each finger-pinch protrusion 4 has two guide posts 7 that are seated in two respective guide tracks 8 located in the inner wall of the device's casing. This guide system assures that in the closing of the circumferential band 3, said band will maintain its circular shape, thus radially bringing all perforating elements equally towards the center of the device.

The device's circumferential band 3 has certain raised portions 9 strategically located on its inner surface. These raised portions 9 radially preadjust the depth of selected perforating elements. This procedure will be fully explained with FIGS. 3 and 4 are discussed.

Discussion of FIGS. 3 and 4 and how this cigarette perforating device works.

A cigarette is placed into the cigarette receiving hole 12 of the perforating elements' 1 guide spool 2. The cigarette may be inserted to any desired distance. Finger pressure is applied to both finger-pinch protrusions 4 in a manner causing said protrusions to come together traveling along the guide tracks 8. In FIG. 3, the broken outline 13 of the finger-pinch protrusion represent their position at rest, and the shaded drawing of the finger-pinch protrusions 4, (FIGS. 3 and 4), represent their final position after pinch pressure has been applied. Note well the resultant positioning of the perforating elements 1 after pinch pressure application (FIG. 3) and the perforating elements at rest (FIG. 1). When the two ends of the circumferential band 4 are brought together, the perforating elements 1 are driven radially inwards, piercing the cigarette barrel 10. When pinch pressure on the circumferential band protrusions 4 is released, the band and perforating elements spring back to their rest position (FIG. 1).

When the perforating elements' 1 guide spool 2 is adjusted (by slight turning — see arrow pointing to three holes FIG. 3 and six holes FIG. 4), to maximum hole perforation (FIG. 4), certain of the perforating elements are radially forced inwards by the raised portions 9 on the inner side of the circumferential band 3, bringing their perforating points to a common, circumferential position equal to the other perforating elements' points already positioned.

By so doing, all perforating elements are in position to achieve maximum depth when pinch pressure is applied to the ends 4 of the circumferential band.

This invention shall be made of molded plastic. This plastic should be of a hard enough nature to maintain its shape but give way under certain assigned pressure.

What is claimed is:

1. A device for perforating the paper wrapper of a tubular smoking item, comprising several spring biased, longitudinally movable, perforating means radially situated under tension in a mounting means; said mounting means having a centrally located opening for receiving a smoking item; said perforating means being held in position by a circumferential spring loaded band means, which is in turn held in position by an outer housing, whereby the circular shape of said circumferential band may be circumferentially reduced by finger pressure to reduce the perforating means radially inwardly into said opening.

2. A device for perforating the paper wrapper of a tubular smoking item, comprising several spring loaded longitudinally movable perforating means, radially situated under tension in a mounting means, said mounting means having a centrally located opening for receiving a smoking item, said perforating means being held in position by a circumferential spring loaded band means, which is in turn held in position by an outer housing, said circumferential band means having a selected number of protruberances on its inner surface for engagement with said perforating means whereby:

the relative distance between the smoking item hole and the perforating means may be varied, said circumferential band means being circumferentially reduced by finger pressure to force the perforating means radially inwardly into said opening.

* * * * *